US006591483B1

(12) United States Patent
Kay

(10) Patent No.: US 6,591,483 B1
(45) Date of Patent: Jul. 15, 2003

(54) METHOD OF FORMING A SPATIALLY FINE MAGNETIC STRUCTURE

(75) Inventor: Nicholas W. Kay, McHenry, IL (US)

(73) Assignee: The Cherry Corporation, Waukegan, IL (US)

( * ) Notice: Subject to any disclaimer, the term of this patent is extended or adjusted under 35 U.S.C. 154(b) by 0 days.

(21) Appl. No.: 09/542,524

(22) Filed: Apr. 4, 2000

(51) Int. Cl.[7] ..... H01F 7/06

(52) U.S. Cl. ..... 29/607; 29/604; 427/128; 427/127; 148/104; 148/105; 209/219; 209/222

(58) Field of Search ..... 29/604, 598, 607, 29/831; 427/127, 128, 190, 197, 201; 148/105, 104; 209/219, 222

(56) References Cited

U.S. PATENT DOCUMENTS

| | | | | |
|---|---|---|---|---|
| 3,816,205 A | * | 6/1974 | Krag | 29/604 |
| 4,341,855 A | * | 7/1982 | Morrison | 430/140 |
| 4,536,451 A | * | 8/1985 | Shen | 428/418 |
| 4,625,392 A | * | 12/1986 | Stokes | 29/598 |
| 5,117,183 A | | 5/1992 | Santos | 324/228 |
| 5,144,735 A | * | 9/1992 | Stark | 29/732 |
| 5,173,139 A | * | 12/1992 | Rippingale | 156/185 |
| 5,477,092 A | * | 12/1995 | Tarrant | 310/43 |
| 5,643,686 A | * | 7/1997 | Isshiki | 428/694 |
| 5,856,668 A | | 1/1999 | Nelle et al. | 250/231.13 |
| 5,895,904 A | | 4/1999 | Nissim | 235/380 |
| 5,934,193 A | | 8/1999 | Menzenski | 101/287 |
| 5,936,236 A | | 8/1999 | Setbacken et al. | 250/231.13 |
| 5,941,122 A | | 8/1999 | Nelson et al. | 73/314 |
| 6,002,250 A | | 12/1999 | Masreliez et al. | 324/207.16 |
| 6,011,389 A | | 1/2000 | Masreliez et al. | 324/207.17 |
| 6,016,056 A | | 1/2000 | Seki | 324/165 |

OTHER PUBLICATIONS

"MICR Check Printing," from Printerm Datascribe, Inc., http://printerm.com/micrdef.htm Site visited Feb. 3, 2000. Approx. 5 pages.

Chuck Bounds, High Performance Powders for Bonded Magnets, Mar. 27, 2000. Conference on Polymer Bonded Magnets, Nashville, TN.

* cited by examiner

*Primary Examiner*—A. Dexter Tugbang
*Assistant Examiner*—Alan Boswell
(74) *Attorney, Agent, or Firm*—Brinks Hofer Gilson & Lione

(57) ABSTRACT

A method is provided for depositing a spatially fine pattern of magnets on a substrate. The substrate can be fabricated from any number of materials, such as plastics, metals or ceramics. When sufficiently magnetized, the magnets will provide a magnetic field that can be sensed by a magnetic proximity sensor, to determine the position of the magnets. The magnets can be arranged in a plurality of patterns, including radial or linear arrangements. The ability to arrange these magnets in varying patterns provides a wide capability of magnetic sensing applications.

8 Claims, 3 Drawing Sheets

Fig. 1
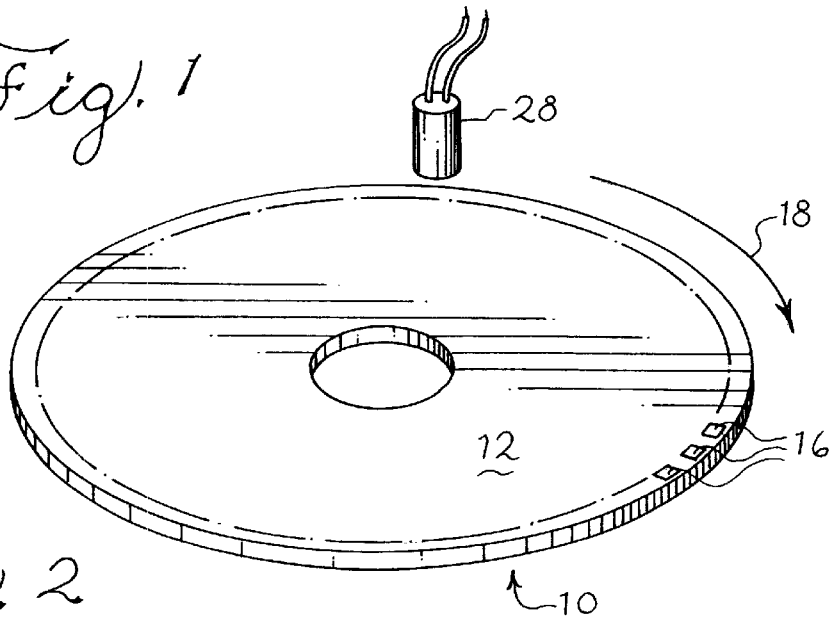
Fig. 2
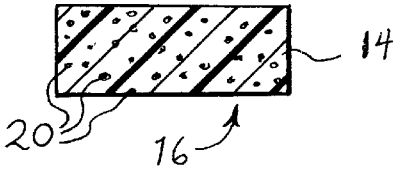
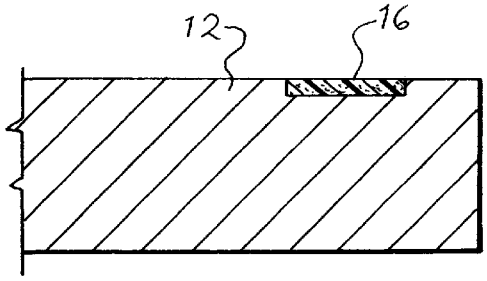
Fig. 3
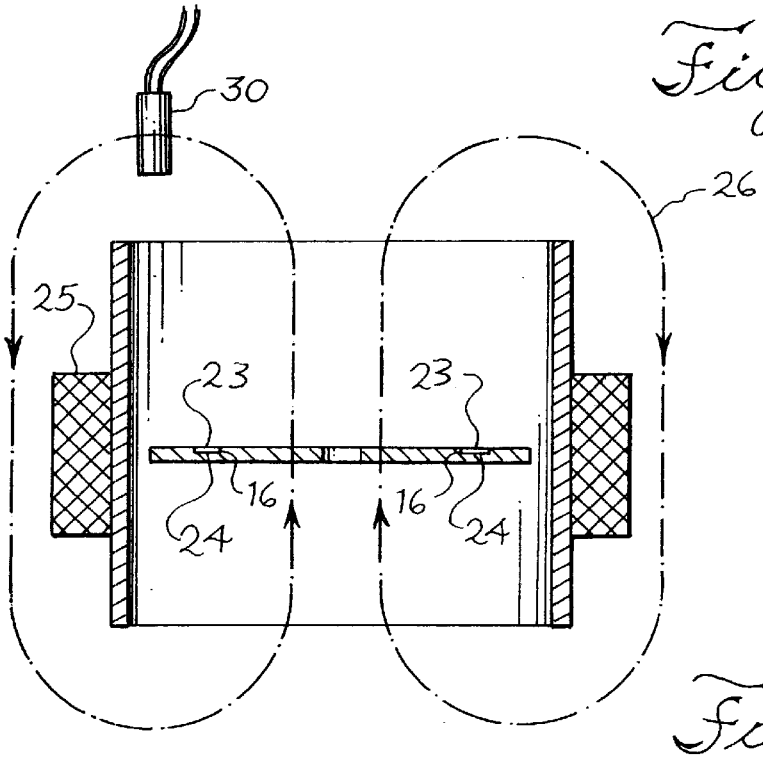
Fig. 4

METHOD OF FORMING A SPATIALLY FINE MAGNETIC STRUCTURE

FIELD OF THE INVENTION

This invention relates to spatially fine magnets and a method of forming spatially fine magnetic structures on a substrate. The magnets may be used to detect the movement and position of the substrate. Such information on position is normally sought in relation to technical or industrial applications, such as motors, generators, actuators, positioners, or other moving or rotating machinery. The invention is directed to a method for forming a spatially fine magnets and to methods for utilizing the magnetic structure in determining position.

BACKGROUND OF THE INVENTION

It is often useful in industrial applications to know the position of the rotor of a motor or generator. In rotary devices, a rotary encoder supplies this information. In like manner, it is often useful to know the position of a linear member, such as an actuator or positioning device. In linear devices, the information may be supplied through a scale placed upon the moving part of a positioner or actuator. In both rotary and linear applications, the moving parts usually include a scale or other device, such as an encoder. The surrounding stationary parts contain devices to read the scale. The information so gathered is then processed with known signal processing techniques, for a desired result.

This result may be phase information useful in electric power generation or use. It may be positioning information useful in a variety of ways from pick-and-place devices to accurate machine tools or coordinate measuring machines. An example of a linear device may be marks made on a glass scale, secured to a moving member of the device, with the position of the scale being sensed optically. Dirt and erosion of surfaces over time can obscure the marks, making this structure susceptible to erroneous readings.

Rotary encoders, such as optical encoders, suffer other disadvantages. Accumulated dirt and disruptions of the light source or the light path will prevent satisfactory operation of the encoder. Elaborate schemes have been devised to overcome some of the difficulties of optical reading. An example would be a rotary device that includes separate conductive parts that are sensed as a rotor rotates and generates signals via capacitive coupling. However, circuitry is required for each arcuate segment of the conductive pattern, and the resulting structure will either be very complex in construction or not very accurate in its resulting resolution.

A series of magnets mounted on a rotating plate is another solution that has merit. In U.S. Pat. No. 5,117,183, a continuous ferromagnetic disk with localized separate magnetic fields is used to sense the position of rotating distributor parts in an internal combustion engine. The localized magnetic fields are sufficiently strong to be detected and to be useful in the application. A complicated looped wire fixture is used to induce the separate magnetic fields in a predetermined pattern on the ferromagnetic disk. The fixture in this device, or in others similar in nature, must magnetize in a very precise pattern, and not outside the pattern. As a result, a very precise and expensive fixture is required for each magnetic configuration.

It would be desirable to provide an encoder or other device with a magnetic structure that provides spatially separate magnetic fields of the required strength, but without requiring a complicated fixture to induce such fields. It would also be desirable to provide a method for manufacturing a spatially fine magnetic structure of this type by means of a simple and inexpensive process.

SUMMARY OF THE INVENTION

The invention overcomes the difficulties of these devices by using a better magnetic solution, rather than an optical or electrical solution. In the invention, fine magnets are provided on a moving linear or rotary substrate. As the linear or rotary substrate moves, a stationary sensor senses the movement of the individual magnets, processes this information, and accurately reports on the movement, and thus the position, of the moving part. The sensor will desirably be, but is not limited to, a Hall-effect sensor or a magnetoresistive sensor, which senses the magnetic field of each magnet.

In a method of the invention, separate magnets are formed on a substrate that may be a plate or a shaft of a rotor. Alternatively, the substrate may be a surface attached to a linear device, such as the ways of a machine tool or a coordinate measuring machine. A sensing device, such as a Hall-effect sensor, is placed on a stationary surface adjacent to the magnets. When the magnets move, the sensor detects the magnetic field of each magnet. The information so gathered is then processed and used to detect the position of the underlying substrate.

Thus, the combination of the magnets and the sensor, along with signals so generated, is useful for determining the position of a rotor, when the magnets and sensor are used in the manner of a rotary encoder. In such an application, a series of magnets is arrayed in a circle, generally around the periphery of a substrate, such as a shaft or a substrate attached to a shaft. The magnets are arrayed in a pattern as desired, with separation and resolution per the design. A larger number of small, fine magnets and tight spacing may be employed for greater resolution. For less demanding applications, fewer magnets may be used with greater spacing between them. The resolution of the angular position of a rotary encoder will depend on the precision of the information made available from the interaction of the magnets and the sensor.

In like manner, if the magnets and sensor are arrayed in a linear fashion, the linear position of the magnets and their substrate may be determined. This information is useful in applications such as position sensing or on/off sensing. A series of magnets is thus placed in line on a way or a surface attached to the item whose position is desired. If greater precision is sought, fine, closely spaced magnets may be used to increase the resolution of the information generated by the interaction between the magnets and the sensor. Some applications may be less demanding, for instance, a device to sense whether the magnet position is consistent with an "on" position or an "off" position. In these cases, fewer magnets and greater spacing may be employed.

Position sensing magnets may be made by using particles of magnetic material in a matrix of an organic resin, such as an epoxy resin. In order for the magnets to have greater magnetic strength and a lasting effect, it is necessary that they be made of magnetically hard or "permanent" magnetic materials. Such materials desirably include, but are not limited to, samarium cobalt, neodymium iron boron and other magnetically hard materials. These materials desirably have a high BH product, and can be easily sensed by a sensor, such as a Hall-effect sensor. These materials should also have high intrinsic coercivity, that is, high resistance to demagnetization, in order that they can be used and re-used for long periods, that is, as a permanent magnet.

This technology differs from that used in magnetic ink character recognition (MICR), used to print checks and bank notes. MICR technologies generally use iron oxide particles in printer's ink. The concentration of particles in the ink must be small in order for rapid, reliable, non-clogging printing. The technology also differs in that the iron oxide particles require a magnet on the MICR reading head to magnetize the particles as a check passes through the head. Only then can the reader detect the magnetic field from the ink, and translate its reading into characters.

BRIEF DESCRIPTION OF THE DRAWINGS

FIG. 1 is a perspective view of an encoder plate with magnets arranged in a circular pattern.

FIG. 2 is a cross-sectional view depicting the composition of the magnets.

FIG. 3 is a cross-sectional view depicting the placement of the magnets on a substrate.

FIG. 4 is a cross-sectional view of sensing magnets on a substrate in association with a ring magnet that induces a magnetic field in the sensing magnets.

DETAILED DESCRIPTION OF THE PREFERRED EMBODIMENT

Figure 5:
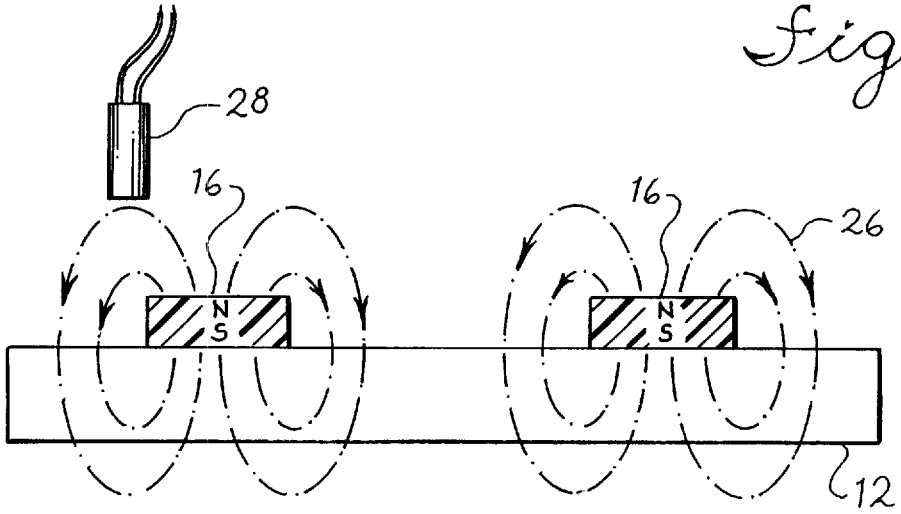
FIG. 5 is a cross-sectional view of magnets and their magnetic fields detected by a sensor.

FIG. 1 depicts an application of the invention applied to an encoder 10 that has a ring substrate 12 that may be attached to a rotor, as for an electrical motor or generator. In this example, the ring has many magnets 16 spaced around its periphery. The magnets are desirably thin in the direction of rotation 18, in order that each magnetic field will be distinct from the other nearby magnet fields. In this manner, each magnetic field, and thus each magnet, will be detected by a sensor 28. The resolution sought by using a larger number of magnets will thus be achieved.

FIG. 2 depicts the composition of a magnet 16 that is formed from magnetic particles 20 in a matrix 22 of a material suitable for holding the particles and retaining them on a substrate. FIG. 3 depicts the placement of a magnet 16 onto a substrate 12, for example, the ring of FIG. 1.

In one embodiment of the invention, a dispersion of magnetic particles is applied to the substrate as a paste in a discrete, fine pattern. Magnetic particles are dispersed in a matrix of nonmagnetic material, as shown in FIG. 2, and are cured, for example by heat or radiation, to form solid, spaced areas of magnetic material that are then magnetized. The use of a dispersion of small particles in an organic vehicle allows for ease of fabrication. This method dispenses with the need for precision machining of each magnet in three dimensions. Instead, it was found the magnets may be easily formed on the substrate by silk screening, stenciling, doctor blading, or similar patterning techniques. Discrete magnets formed in this fashion may also be magnetized in manufacturing with a single simple fixture, as opposed to the complex fixtures that have heretofore been used to magnetize separate areas of a unitary magnetic structure.

In manufacturing the magnets of FIGS. 1–9, magnetic particles are mixed with an organic binder or matrix to form a dispersion. While not limited to these, examples of binders are epoxy resins, polyester resins and silicone resins. All of these materials are available in a variety of moduli, strengths, hardnesses and viscosities. The viscosity of the resin will determine an upper limit on the relative amount of magnetic material that can be dispersed in a given amount of resin. The viscosity is also important in the ease of application of the dispersion to the substrate. The hardness and modulus of the resin after it is cured will determine the "flex" or stiffness of the cured magnet on the substrate. It will also be important that the magnet adhere firmly to the substrate for the durable performance of the device.

Magnetic particles are desirably formed from magnetically hard or "permanent" magnetic materials. These are materials, which do not demagnetize when subjected to repeated exposure to electrical and magnetic fields. Examples are samarium cobalt type alloys and neodymium boron iron alloys. Alnico-type alloys may also be used, although they are more easily subject to demagnetization. Magnetically hard materials are now available in particulate form from companies such as Magnequench International, Inc., Anderson, Ind. These materials are available in particle sizes from 5 microns to sub-micron sizes. For the purpose of the invention, any of the particle sizes are useful. The larger particles can desirably be used in the manufacture of larger magnets, while the smaller particles will allow for the formation of smaller magnets and higher resolution.

FIG. 4 depicts the manner in which a simple permanent magnet fixture 25, for example, in the shape of a ring, is used to induce a magnetic field in the sensor magnets 16 made as previously described. The opposite poles 22, 24 of each magnet 16 generate a field that corresponds to the inducing field 26 of the ring magnet fixture. A sensor 30, for example, a Hall-effect sensor, may monitor the intensity of the field 26 in order to induce a field of the proper magnitude in the magnets 16. The ring magnet may be an electromagnet to allow adjustment of the intensity of the inducing magnetic field.

A Hall-effect sensor may also be used to detect the magnets in the operation of the invention. It is preferable to place such a sensor as close as practicable to the substrate and the magnets, yet not so close that it touches, especially in rotary applications, where the magnet or magnets may be rotating at substantial speed. FIG. 5 shows two magnetized magnets 16 of this invention placed on a magnetically permeable substrate 12 and their concentrated magnetic fields 26 being detected by sensor 28. If magnetically non-permeable materials, including polymers, non-ferrous metals such as aluminum, or certain steels are used, the magnetic fields of the magnet 16 will be less concentrated in the substrate and will extend more diffusely toward the sensor 28.

Accordingly, an apparatus incorporating at least one spatially fine magnet on a substrate practices the invention. A suitable sensor, such as a Hall-effect sensor, is placed sufficiently close to detect the magnet or magnets. Known electrical circuitry (not shown) is used to power the sensor and detect a signal that is generated in response to a sensed magnetic field. Using this signal, the position of the magnet, and thus the substrate, can be calculated. As an example, the position of a rotor on an electrical motor or generator may be determined. Thus, the sensor can function to detect the presence of a magnet, and therefore the position of the magnet and its substrate.

In an embodiment of the invention illustrated in FIG. 1, the magnets 16 are disposed circumferentially on a disk-shaped substrate 12, such as an encoder wheel or a shaft. The magnets may be used, in conjunction with a sensor 28, such as a Hall-effect sensor, or a magneto-resistive sensor, to determine the position of the magnets, and thus the substrate, as the substrate revolves in the direction of arrow 18.

Figure 6:
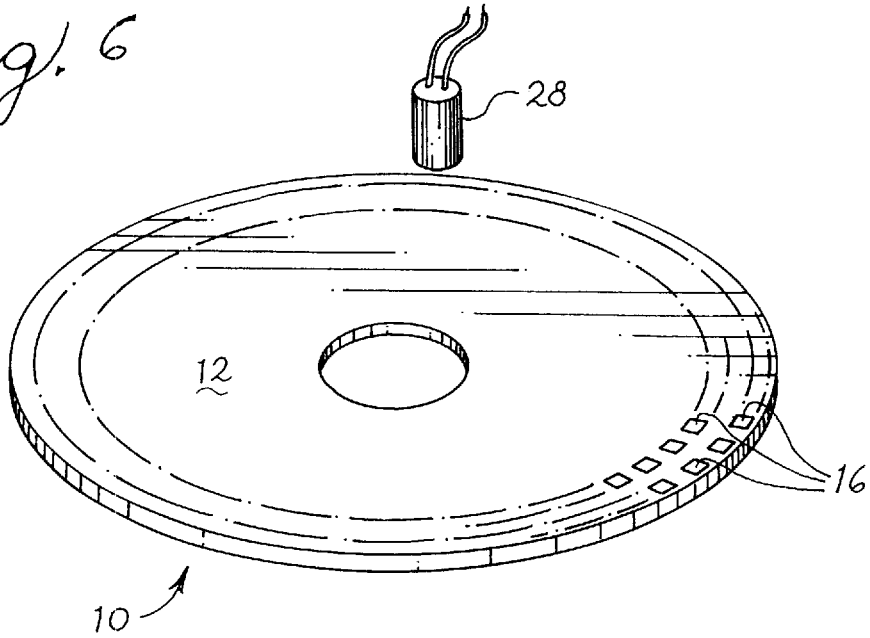
FIG. 6 is a perspective view of an alternative arrangement of magnets on a substrate.
Figure 7:
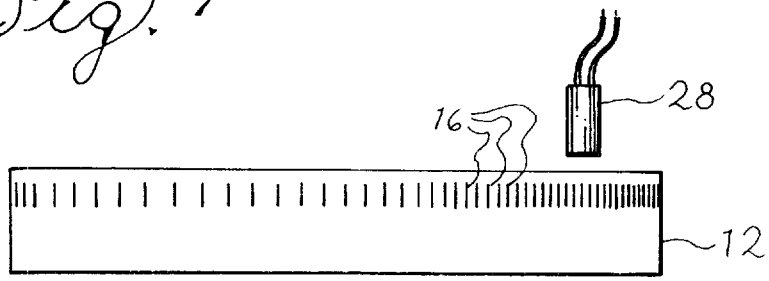
FIG. 7 is a plan view of magnets mounted in a linear array.

FIG. 6 depicts a double row of magnets on a similar rotor, with each numeral of the figure having the same meaning as in the previous figures. The encoder 10 is therefore made of a substrate 12 that is attached to a rotor, for example, of an electrical motor or generator. There are now two rows of magnets 16 spaced in an alternating pattern about the periphery of the substrate, and a sensor 28. With a second row of magnets, spaced between the first, outer row of magnets, the ability to determine angular position is greatly enhanced, since there will be twice the resolution of an encoder with only a single row.

When using either a single row of magnets or more than one row, this apparatus has the ability to determine the speed of rotation. Each magnet will generate a discrete signal as it rotates past the sensor. The frequency of signals may be used to determine the frequency of rotation, and thus the speed of the rotor. Radial rows of magnets may also be arranged to generate bit codes that further delineate the rotary position of the disk substrate.

The invention is not limited to rotary applications. In another embodiment shown in FIG. 7, a row of magnets 16 is placed on a substrate 12 in a line, to be detected by sensor 28. The magnets are magnetized during the manufacturing process and the substrate is placed on an object of interest. Applications may include measuring machines, positioners and machine tools, or any application requiring accurate knowledge of position in a linear dimension. In addition, the magnets of this invention may be used as indicators of on/off status. Applications may include machines in which both rotary and linear arrays of magnets are used, such as positioners or machines having both rotary and linear axes, such as 4-axis or 5-axis machines. When used in this fashion, linear speeds may also be determined by the same signal-processing techniques used to determine rotary speeds.

In practicing the invention, the first step is to select magnetic particles and a suitable matrix. The particles are mixed with the desired matrix, such as an epoxy resin. The mixture of particles and resin is then applied to the substrate as desired, for example, in a spatially fine geometric pattern with magnets spaced on the order of 1 to 20 thousandths of an inch (0.00254 to 0.051 cm.). The composite mixture or dispersion of resin and magnetic particles will desirably have as high a percentage of magnetic particles as possible in order to have the greatest efficacy as a magnet. The mixture may be made as thick or as thin as desired, that is to say, of any viscosity from a thick liquid to a thick paste. The more concentrated the magnetic particles, and the smaller the particles, the thicker will be the resulting dispersion. The resin or matrix should be selected for the appropriate viscosity and for the desired method of application of the mixture.

Figure 8:
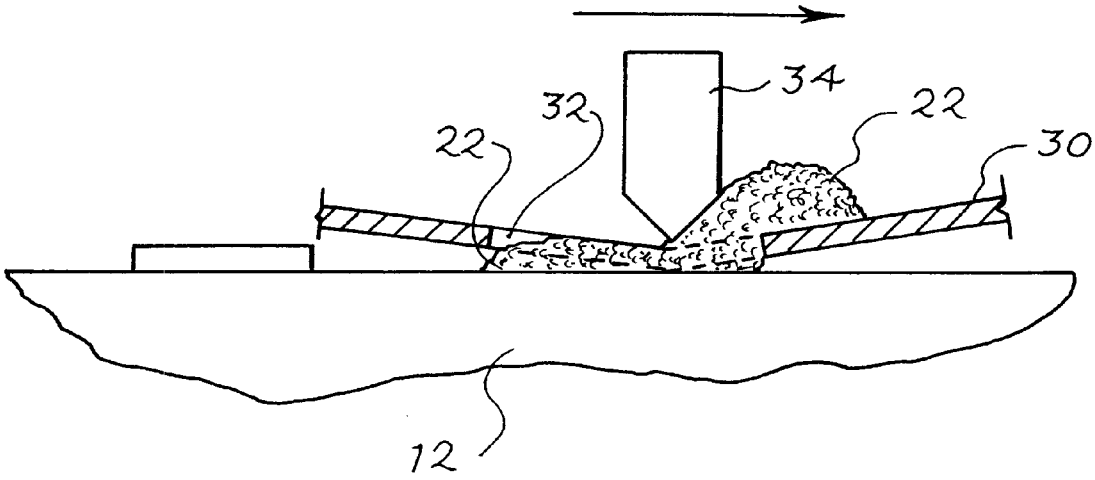
FIG. 8 is a cross-sectional side view of a substrate receiving a dispersion of magnetic material from a silk screen manufacturing method.

In order to obtain a discrete, formed magnet, control over application of the dispersion is required. The dispersion may be applied by any convenient method. These methods may include application by hand, as from a caulking-type apparatus or with a putty-knife. For faster, more automated application to mass-production, methods such as those used in coating can desirably be employed. Stencils may be used, with a pattern formed on a stencil, and subsequently applied to a substrate. Alternatively, a pattern may be formed on a silk-screen, and the mixture applied to the desired substrate by conventional machinery. FIG. 8 is a cross-sectional side view of a substrate 12 being silk-screen processed, by having a dispersion 22 with magnetic particles applied to the substrate through a pattern formed on a silk screen 30 and applied to the substrate. FIG. 8 depicts the screen 30 with openings 32 and a wiper 34, forcing the dispersion 22 onto the substrate 12.

Figure 9:
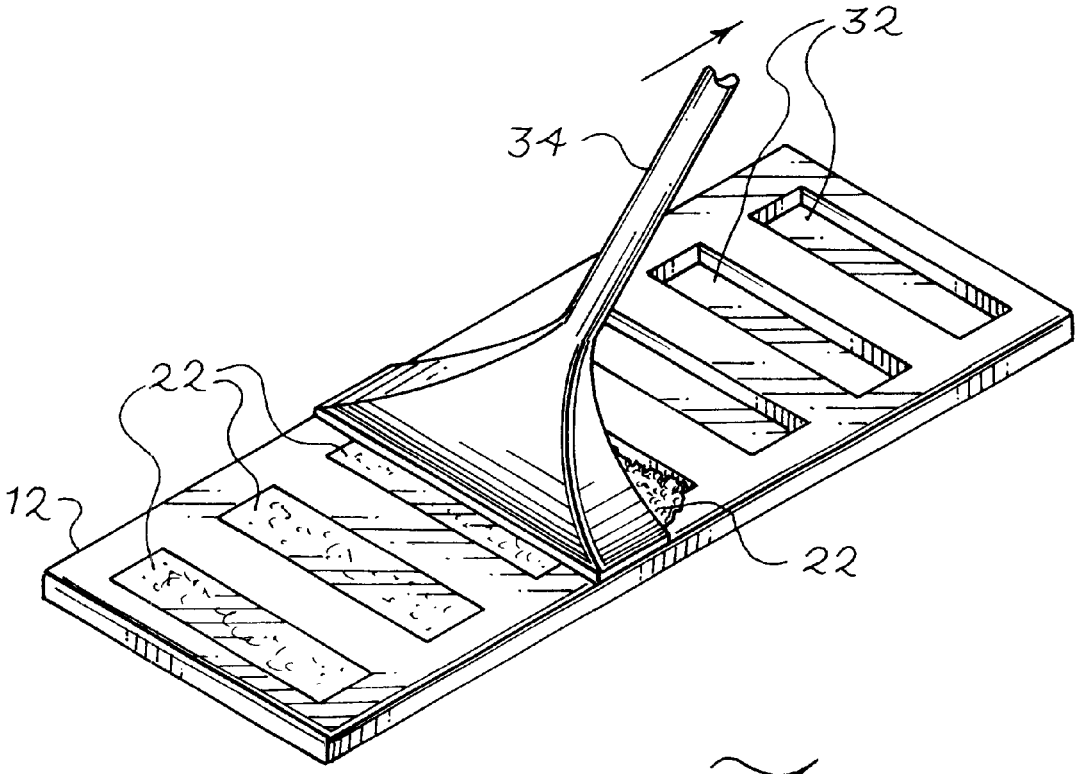
FIG. 9 is a perspective view of a dispersion of magnetic material pressed into recessed areas of a substrate by a doctor blade.

As shown in FIG. 9, the dispersion 22 may also be applied via a wiper or doctor 34 blade into low-lying recessed areas 32 of a substrate 12 that form a desired pattern for magnets. The recessed areas in a substrate or object may be formed, for example, by photolithographic techniques, or the recessed areas may be formed by other standard manufacturing techniques, such as by stamping, machining or etching onto a variety of substrates.

In another embodiment of the invention, spin deposition is used to deposit a dispersion of magnetic particles into recessed areas of a substrate. This technique is most useful when it is desired to deposit the magnets into areas not easily accessible. For instance, it may be desirable to place a magnet or magnets in a boreshaft so that the axial position of a shaft in the bore may later be determined. One way to practice the invention is to place the magnets into recesses in the bore. Spin deposition consists of spinning a cone-shaped cup while applying a magnetic particle dispersion to the cup. The centripetal force applied by the spinning cup forces the dispersion outward, placing it into recesses preformed in a desired geometric pattern. Later, the dispersion is cured and may be machined to size or etched as desired. Alternately, the dispersion could be etched before it is cured.

After application, the dispersion is cured, the resin hardens, and the magnet is formed permanently on its substrate. In one embodiment of the invention, the magnetic particles are dispersed into a matrix of a liquid resin, such as an epoxy resin. Epoxy resins, such as those made by the Dow Chemical Co. or the Shell Oil Chemicals Co., are available in a variety of viscosities and cured properties. The viscosity of the mixture should be low enough to enable the admixing and thorough wetting of the magnetic particles by the resin. Although not required, the particles will desirably be mixed with the less-viscous or larger component of a two-part epoxy resin, for convenience. Later, the hardener may be added just before application of the magnet-resin mixture to the substrate. This order of mixing is not mandatory, but will give the longest pot-life and greatest working time for a particular batch of resin and magnetic particles. After application to the substrate, the resin is cured according to the cure schedule of the resin manufacturer, normally by the application of heat. Some epoxies, including single component epoxy materials, may alternatively be cured by a longer time at room temperature.

One problem that may be encountered with the use of two-component epoxy resins in such an application is the cleaning of the equipment used to apply the resin. Because epoxies tend to have short pot lives, it may be desirable to consider other resins with longer pot lives, and which are more amenable to cleanup. These would include any resin whose cured properties and adhesion to the substrate are acceptable in the application. Candidates would include polyesters, vinyl esters, urethanes, polyimides, and silicones. Especially desirable for longer pot life and easy cleanup would be any resins curable by photochemistry. These would include, but not be limited to, resins such as polysulfones, acrylics, methacrylics and polyesters curable by light or radiation chemistry.

Resins curable by light or radiation would be especially valuable in methods used for mass production. After applying the resin-particle dispersion to the substrate, the mix remains uncured until it is exposed to light or radiation of the proper wavelength and intensity. The magnets may then be magnetized before curing. After curing the desired areas, the uncured resin may be removed using typical photolithographic techniques. This technique may also be used in those applications in which a magnet is formed in a recessed area, and the excess material may be difficult to remove.

Before curing such radiation-curable mixtures, however, other operations may be performed on the articles as desired. For instance, each article may be inspected, by conventional or automated means, before curing. This will afford the opportunity to rework any mis-applied or smudged article before the resin is cured. Cleanup of the equipment used to apply the resin will be more easily accomplished if the resin is not cured. Examples of materials which may be used in these applications, are those resins, mentioned above, and formulations made from them, which are curable by infrared light, by electron beam radiation, or by other photochemical means.

It may also be desirable to magnetize the deposited magnets, and also to orient their dipoles before the resin is cured. Magnetization is usually accomplished by exposing the object to be magnetized to a strong magnetic field. In order to accomplish this, it is necessary to bring the object into close proximity with the magnetic field. The magnets of the present invention will be amenable to this process. They are fabricated in small sizes onto substrates. An electromagnet, or other source of a sufficiently strong magnetic field, may easily approach and magnetize the surfaces onto which the magnets are deposited. Such equipment is available from Oersted Technology, Inc., Tualatin, Oreg. Magnetization of the magnets in the uncured state may increase the energy product of the magnets, and the magnetic field strength, by a factor of 2 to 3.

Magnetization may be accomplished with room-temperature cure, heat cure, or radiation-cure materials, each with its own particular advantage. With room-temperature cured materials, time may be available for such a subsequent operation before the resin cures. With some materials requiring an elevated temperature for cure, a gel stage may be reached at an early stage, preventing any orientation of the particles in the desired direction. Resins that cure via radiation or photochemistry afford a greater degree of control over process timing, but tend to be more expensive.

In another aspect of the invention, the particles may be dispersed into a thermoplastic matrix. The magnetic material may then be deposited onto the desired substrate through plastic application processes, such as compression molding or injection molding. Thermoplastics are not as convenient to work with as thermoset materials, but have certain advantages in large-scale manufacturing. Thus, if it were determined that fine magnets should be insert-molded onto substrates on a sufficiently large scale, either compression molding or injection molding could be suitable for such application. Post-application curing is not normally required with thermoplastics.

In another embodiment of the invention, magnetic particles are mixed with glass, ceramic, or glass-ceramic particles. The mixture is deposited onto the desired substrate in the desired form. Afterwards, the mix is fired or sintered to achieve structural integrity. In like manner, magnetic particles may be admixed with cements or ceramic cements, and subsequently cured as appropriate, including a step for applying a sealer if recommended by the cement manufacturer. Cements that may be desirable are those made by the Sauereisen Co. of Pittsburgh, Pa., or Aremco, of Ossining, N.Y. The advantage of these high-temperature materials may be in applications for use at high temperature. Thus, it may be desirable to deposit fine magnets onto a metal structure, such as steel or aluminum, for use at a temperature above those suitable for organic matrices. In these applications, the use is still subject to the ability of the magnetic particles, and their magnetic properties, to survive processing at sintering temperatures, as well as the temperature of use.

In another embodiment of the invention, the mixture of resin and magnetic particles is applied to the substrate through a silk-screen method. A screen is prepared, with openings through the mesh in a desired pattern. The screen is laid atop the substrate and the mixture is applied to the screen. A blade or squeegee then forces the mix through the openings in the screen, applying the mixture to the substrate. The screen is removed and the substrate is then processed through the remaining steps, such as magnetizing the dispersion and curing. The screen is then placed atop another substrate and the process is repeated for another article.

In yet another embodiment of the invention, a stencil is prepared with surfaces raised in the desired pattern. The mixture is applied to the stencil, and the stencil is then pressed onto the substrate, transferring the mix to the substrate in the desired pattern. If desired, the stencil may be placed onto a roll, such as a coating roll. Substrates may then be coated by passing them over a bed-above which the coating roll passes, thereby coating the substrates. The mix is replenished on the coating roll by a second roll, which passes through a reservoir of a mix of the particles and a resin. Thus, substrates may be coated in what resembles a conventional coating process, with one-sided or two-sided coating. The magnets so formed may be used on only one side of a given substrate or on both sides. In another embodiment of the invention, discrete magnets may be adhered to the substrate with an adhesive, similar to the resins above.

It will be readily understood that one advantage of the invention is that the magnets so formed may be dimensionally small, for example, with the same or similar height and width dimensions, measured in a few thousandths of an inch. The finer the magnets, the greater will be the ability of this method and apparatus to achieve accuracy. Thus, if fine resolution of positional accuracy is desired, the magnets must be made very thin. It has been found that dispersions can be deposited to provide detectable magnets as thin as 0.001 inches (0.00254 cm.) wide when they are deposited in layers as thin as 0.001 inches (0.00254 cm.) thick and about 0.5 inch (1.27 cm.) long. Thus, with the methods listed above, magnets may be deposited onto substrates up to about 50 per inch, or with spacing from about 1 to 10 mils for fine spatial patterns. If less resolution is required, larger magnets may be used, for example, 0.020 inches (0.051 cm.) wide and spaced farther apart, for example, 0.020 inches (0.051 cm.). Alternatively, dimensions could be even greater, as needed.

While this invention has been shown and described in connection with the preferred embodiments, it is apparent that certain changes and modifications, in addition to those mentioned above, may be made from the basic features of this invention. For example, magnetically permeable or nonpermeable substrates may be used without departing from the invention. A permeable substrate concentrates the magnetic field, keeping it closer to the magnet. A sensor placed close to the magnet will thus detect the field. Alternatively, the substrate may be made from plastic, aluminum or a steel non-permeable to magnetic fields, thus diffusing the magnetic field.

In this case, the field will extend further from the substrate but will be weaker for sensing by a Hall-effect sensor. The spatially fine magnetic structures of the invention may be used in conjunction with any desired type of magnetic sensor or other electrical or electromagnetic device without departing from the invention. Accordingly, it is the intention of the applicants to protect all variations and modifications within the valid scope of the present invention. It is intended that the invention be defined by the following claims, including all equivalents.

I claim:

1. A method of forming spatially fine magnets, comprising:

depositing a dispersion of magnetic particles in a matrix onto a substrate; and magnetizing the particles, wherein the magnets are about 0.001 inches (0.00254 cm) wide to about 0.020 inches (0.051 cm) wide, and spaced about 0.001 inches (0.00254 cm) to about 0.020 inches (0.051 cm) apart.

2. The method of claim 1, wherein said particles are dispersed in a thermoset matrix, said method further comprising curing said matrix.

3. The method of claim 1, wherein said particles are dispersed in a thermoset matrix, said method further comprising curing said matrix thermally or photochemically.

4. The method of claim 1, wherein said particles are dispersed in a thermoplastic matrix.

5. The method of claim 1, wherein said particles are dispersed in a matrix selected from the group consisting of glass, ceramic, and cementacious materials.

6. The method of claim 1, wherein said dispersion is deposited onto the substrate through a silk screen.

7. The method of claim 1, wherein said dispersion is deposited onto the substrate by an application roll.

8. The method of claim 1, wherein the magnets comprise particles selected from the group consisting of samarium cobalt, neodymium iron boron, and magnetically hard materials.

* * * * *